US009657453B1

(12) United States Patent
Shin

(10) Patent No.: US 9,657,453 B1
(45) Date of Patent: May 23, 2017

(54) REMOVABLE GROUND ANCHOR BODY USING SPRING

(71) Applicants: Samjin Steel Ind. Co., Ltd., Gimpo-si, Gyeonggi-do (KR); Hyun Taik Shin, Bucheon-si, Gyeonggi-do (KR)

(72) Inventor: Hyun Taik Shin, Bucheon-si (KR)

(73) Assignees: Samjin Steel Ind. Co., Ltd., Gimpo-si (KR); HYUN TAIK SHIN, Bucheon-si (KR)

( * ) Notice: Subject to any disclaimer, the term of this patent is extended or adjusted under 35 U.S.C. 154(b) by 0 days.

(21) Appl. No.: 15/051,735

(22) Filed: Feb. 24, 2016

(30) Foreign Application Priority Data

Dec. 15, 2015 (KR) ..... 10-2015-0179334

(51) Int. Cl.
*E02D 5/80* (2006.01)

(52) U.S. Cl.
CPC ..... *E02D 5/80* (2013.01); *E02D 2220/00* (2013.01); *E02D 2600/30* (2013.01)

(58) Field of Classification Search
CPC E02D 5/80; E02D 5/54; E02D 17/202; E02D 2600/30; E02D 2220/00; E21D 21/0033
USPC ..... 405/259.1, 262, 284, 302.2, 302.4; 52/155, 156, 165
See application file for complete search history.

(56) References Cited

U.S. PATENT DOCUMENTS

2005/0050817 A1* 3/2005 Shin ..... E04C 5/122 52/223.1
2008/0302035 A1* 12/2008 Shin ..... E02D 5/765 52/223.13
2011/0135402 A1* 6/2011 Leppanen ..... E21D 21/008 405/259.2
2015/0218772 A1* 8/2015 Shin ..... E02D 5/54 52/165

FOREIGN PATENT DOCUMENTS

KR 10-0963565 B1 6/2010
KR 1591657 * 9/2016
WO WO 2011/027931 * 10/2011 ..... E02C 5/80

* cited by examiner

*Primary Examiner* — John Kreck
*Assistant Examiner* — Carib Oquendo
(74) *Attorney, Agent, or Firm* — Novick, Kim & Lee, PLLC; Jae Youn Kim

(57) ABSTRACT

A removable ground anchor body uses a spring and includes: a waterproof cap formed with an upward screw groove at an inner lower end; a housing that is coupled to a lower end of the waterproof cap and is formed with an upward locking protrusion therein; a body that is formed with a rotating main spring coupled to a screw groove of the waterproof cap at the top and is formed with a stopper on an outer peripheral edge to be locked to the locking protrusion of the housing; a stopper presser that is installed between the waterproof cap and the body and brings the lower end into close contact with the stopper upper surface of the body; a strand wire wedge; a wedge hold; and a head coupler.

5 Claims, 6 Drawing Sheets

REMOVABLE GROUND ANCHOR BODY USING SPRING

CROSS REFERENCES TO RELATED APPLICATIONS

This application claims priority to Korean Patent Application No. 10-2015-0179334, filed on 15 Dec. 2015, in the Korean Intellectual Property Office, the contents of which is hereby incorporated by reference in its entirety.

BACKGROUND OF THE INVENTION

Field of the Invention

The present invention relates to a removable ground anchor body using a spring, and more particularly, to a removable ground anchor body using a spring that is coupled to an end portion of a fixing portion of a pre-stressed concrete (PC) strand wire such that a perfect coupling state is kept even by movement or external impact in the field and at the same time a tensile material such as a PC strand wire can be easily separated and removed even by man power.

Description of the Related Art

In general, a slope reinforcement structure coupled with a PC strand wire is to form holes in the ground by drilling, insert a tensile material with excellent tensile strength into the drilled holes with an internal fixing agent and inner member, thereafter, firmly fix it by injecting with a grouting material such as concrete, and thereafter, apply a load to a free end of the tensile material, fix it with an external fixing material and ensure a strong fixation force to safely support structures such as earth retaining walls. Such a slope reinforcement structure is widely used in a soil retailing construction for preventing the collapse of the surrounding ground at the time of excavation for underground structures of the building construction and civil engineering, a construction for suppressing the sediment loss of the soft ground incision surface.

As the tensile material used in the slope reinforcement structure, a tensile material made by twisting a plurality of strands of deformed bars or steel wires is used. Since the tensile material has outstanding strength, if it is left in the ground it becomes a ground obstacle, and there is a risk of causing a problem such as the ground compensations in future development of adjacent land.

To solve this problem, a removable internal fixing material for ground anchor for easily removing the tensile material embedded in the ground after the construction has been known.

Such a conventional anchoring body has a configuration in which an inclined surface is formed inside a cylindrical body, a wedge divided into approximately three pieces is provided on the inner surface of the inclined surface, the tensile material seats on the central portion of the wedge, and an elastic spring for pressing the wedge forward is provided at the rear end of the wedge to press the wedge to prevent detachment and separation of the tensile material.

However, according to the structure of the conventional anchoring body, in order to remove the tensile material, the tensile material is pressed to retract the wedge provided on the inside of the cylindrical body, and at the same time, the tensile material can be removed in the state of expanding the central portion. However, even when retracting the wedge, the expansion is not correctly performed, and even when the wedge is moved back to perform the expansion, since the spring provided in its rear end continuously presses the wedge, there is still a problem in that a burden may occur upon removal of the tensile material and the separation may not be performed correctly.

In the conventional removable internal fixing agent, there was a problem in that it was not possible to easily remove the tensile material in the future, when an impact is applied to the internal fixing material of the PC strand wire in the course of transporting the PC strand wire manufactured in the factory to a construction site or in the course of handling at the time of construction work.

Furthermore, since it is almost impossible to reassemble the anchor body in which the coupled state is separated due to the external impact in the field, a major obstacle was caused in the progression of construction.

There is a technique of Korean Patent Registration No. 10-0963565 in which these problems are improved, although such a technique presses the wedge by elasticity of the upper spring to continually maintain the bound state with the tensile material and allows the re-coupling, while suppressing the wedge from being separated due to the external impact during transportation or handling process, there were drawbacks in which it was not possible to basically prevent the separation of the tensile material due to the spring contraction caused by external impact energy from the outside, and it was not possible to remove the tensile material by the man power after the installation of the slope.

SUMMARY OF THE INVENTION

An aspect of the present invention is directed to provide a removable ground anchor body using a spring that can maximize and properly cope with the supporting force depending on to the soil behavior, and can easily separate a tensile material such as a PC strand wire coupled to the anchor structure by the manual force.

Another aspect of the present invention is directed to provide a removable ground anchor body using a spring which allows a safe and perfect assembly and coupling state even in case of the movement of the anchor body and the external impact in the field, prevents the erroneous operation, and improves the reliability of the product.

Still another aspect of the present invention is directed to provide a removable ground anchor body using a spring that allows easier re to coupling by rotation even when the coupling state of the anchor body is separated.

To achieve the above object, according to an aspect of the present invention, there is provided a removable ground anchor body using a spring that includes a housing that is coupled to a lower end of a waterproof cap and is formed with a locking protrusion therein; a body that is formed with a rotating main spring coupled to a screw groove of the waterproof cap at the top and is formed with a stopper on an outer peripheral edge to be locked to the locking protrusion of the housing; a stopper presser that is installed between the waterproof cap and the body and brings the lower end into close contact with the stopper upper surface of the body; a strand wire wedge that is coupled to the lower portion of the body and is made up of a plurality of pieces; a wedge hold that is formed with a tapered hole for guiding the strand wire wedge and has a cushioning auxiliary spring flexibly installed at the bottom; and a head coupler that is coupled to the lower portion of the housing to support the wedge hold and is formed with an entry hole in the length direction, wherein the strand wire edge can be controlled, while vertically mutually complementing by the rotating main spring and the cushioning auxiliary spring, and the stable coupling state position of the tensile material can be maintained in the assembled state by the stopper.

Therefore, according to the removable ground anchor body using the spring of the present invention, since the stopper of the body is controlled to be located between the locking protrusion and the stopper presser, and the elasticity of each of the rotating main spring and the buffering auxiliary spring acts on the upper and lower portions of the strand wire wedge, it is possible to maintain a proper elasticity even in the case of an external impact, and the elasticity strength of the rotating main spring and the buffering auxiliary spring are offset at the upper and lower portions. Thus, the strand wire wedge can maintain a continually stable and perfect assembled state even in the case of in the front end of the tensile material.

In addition, when removing the tensile material, since the stopper of the body is already in a removed state, the strand wire wedge can completely separate and remove the tensile material away from the tapered hole, and at the same time, when the tensile material rotates, the elasticity of the buffering auxiliary spring acts on the waterproof cap side to induce the strand wire wedge to smoothly escape from the tapered hole of the wedge hold. Thus, it is possible to conveniently separate and remove the tensile material only by the man power using a basic device.

In particular, since the wedge holder and the head coupler are separately installed, there is an effect capable of preventing the tensile material of the strand wire or the like from coming off due to any impact, maximizing the role of the spring and facilitating the removal of the tensile material.

BRIEF DESCRIPTION OF THE DRAWINGS

The above and other aspects, features and advantages of certain exemplary embodiments of the present invention will be more apparent from the following description taken in conjunction with the accompanying drawings, in which.

DETAILED DESCRIPTION OF EXEMPLARY EMBODIMENTS

Figure 1:
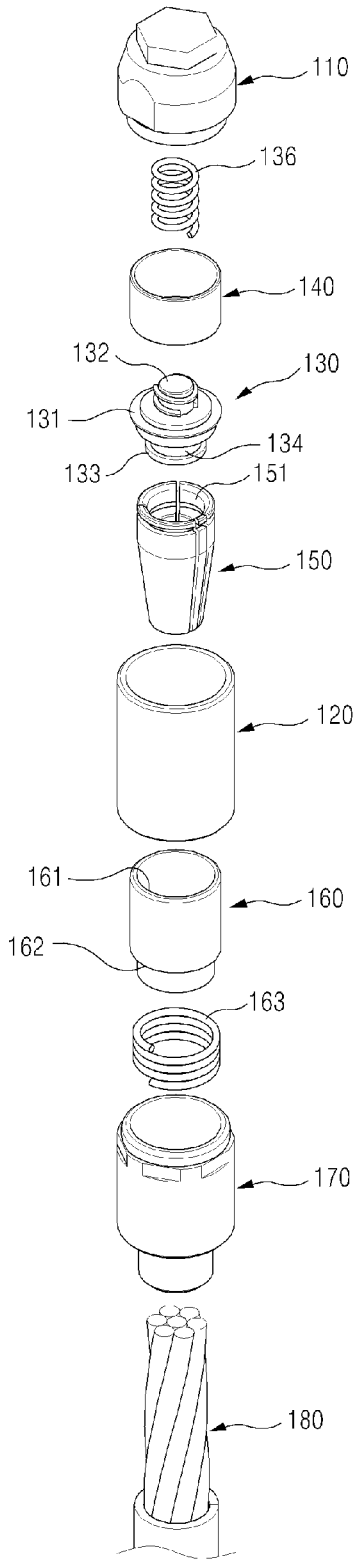
FIG. 1 is a perspective view illustrating a separated state of a removable ground anchor body using a spring according to the present invention.
Figure 2:
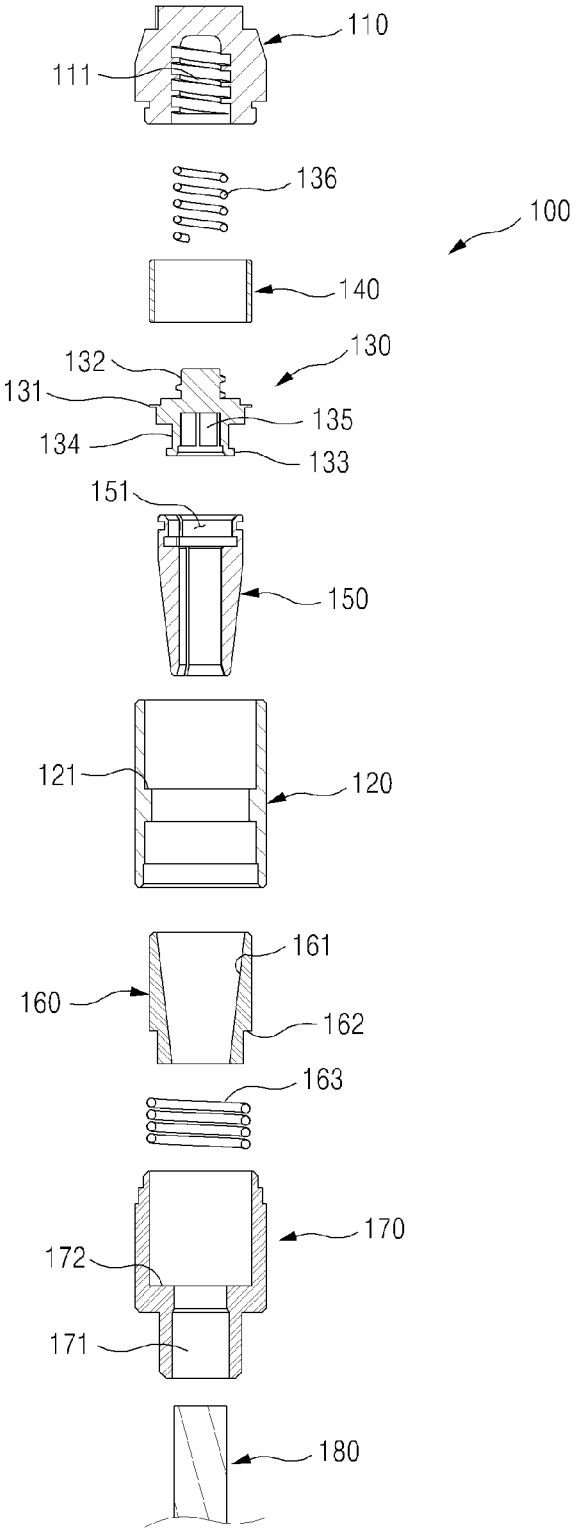
FIG. 2 is a cross to sectional view illustrating a separated state of the removable ground anchor body using the spring according to the present invention.

Exemplary embodiments of the present invention will be described below in detail with reference to the accompanying drawings. Wherever possible, the same reference numerals will be used to refer to the same elements throughout the specification, and a duplicated description thereof will be omitted. It will be understood that although the terms "first", "second", etc. are used herein to describe various elements, these elements should not be limited by these terms. These terms are only used to distinguish one element from another element.

Hereinafter, an embodiment of the present invention will be described in detail with reference to the accompanying drawings.

As illustrated in FIGS. 1 to 6, a removable ground anchor body 100 using a spring that includes a waterproof cap 110 formed with an upward screw groove 111 from an inner lower end; a housing 120 that is coupled to a lower end of the waterproof cap 110 and is formed with a locking protrusion 121 corresponding to the waterproof cap 110 therein; a body 130 that is formed with a rotating main spring 136 coupled to a screw groove 111 of the waterproof cap 110 at the top and is formed with a stopper 131 on an outer peripheral edge to be locked to the locking protrusion 121 of the housing 120; a stopper presser 140 that is installed between the waterproof cap 110 and the body 130 and brings the lower end into close contact with the stopper 131 upper surface of the body 130; a strand wire wedge 150 that is coupled to the lower portion of the body 130 and is made up of a plurality of pieces; a wedge hold 160 that forms a tapered hole 161 for guiding the strand wire wedge 150 and has a cushioning auxiliary spring 163 flexibly installed at the bottom; and a head coupler 170 that is coupled to the lower portion of the housing 120 to support the wedge hold 160 and is formed with an entry hole 171 in the length direction.

The watertight cap 110 is formed with the screw groove 111 inside upward from the lower end, and is preferably formed with a bolt head-shaped protrusion at the top to facilitate the fastening operation of the housing 120.

The housing 120 is formed in a cylindrical shape that vertically penetrates, is provided with a packing or the like at the top, can fasten the watertight cap 110 by a conventional coupling means such as screw coupling or the like, is formed with a locking protrusion 121 in the upward direction on the inner peripheral edge, and the upper side of the stopper 131 of the body 130 is locked by the locking protrusion 121.

The screw protrusion 132 protrudes upward at the center of the upper surface of the body 130, and a rotating main spring 136 coupled to the screw groove 111 of the waterproof cap 110 is integrated to the screw protrusion 132, by being coupled upward. Thus, with the rotation or the reverse rotation of the body 130, the rotating main spring 136 also rotates and reversely rotates to rise or fall along the screw groove 111, and the body 130 is also formed to rise and fall.

In addition, a flange-shaped stopper 131 is formed on the outer peripheral edge of the body 130 to be locked to the top of the locking protrusion 121 of the housing 120.

In addition, a coupling protrusion 133 protrudes downward from in the bottom center of the body 130, and an annular coupling groove 134 is formed on the outer peripheral edge of the coupling protrusion 133 so that the strand wire wedge 150 can be coupled thereto, and a key groove 135 is preferably formed upward on the lower end surface of the coupling protrusion 133 so that the front end of the tensile material 180 can be fitted and key-coupled thereto.

The stopper presser 140 is formed in a cylindrical shape and is inserted into the housing 120 so as to be positioned between the lower end of the watertight cap 110 and the stopper 131 of the body 130. Thus, the stopper 131 can be ideally locked on the locking protrusion 121 of the housing 120 to suppress the movement.

Here, the stopper presser 140 may also be used by being integrally formed with the watertight cap 110, it is preferably used in a separated state in view of the molding ratio or the like.

The strand wire wedge 150 is fitted and connected to the coupling groove 134 of the body 130 by forming the upward locking protrusion 151 on the upper side, and is generally formed in three pieces by trisection.

The wedge hold 160 is formed with a tapered hole 161 to be able to fix or release the tensile material 180 by guiding the strand wire wedge 150, and is formed with a locking jaw 162 on the lower peripheral edge.

In particular, since the wedge hold 160 is provided with a buffering auxiliary spring 163 corresponding to the locking jaw 162 to flexibly install the wedge hold 160 upward, the strand wire wedge 150 can be preferably fitted to the tapered hole 150 to stably maintain the fixed state of the tensile material 180.

The head coupler 170 is preferably coupled to the bottom of the housing 120 to support the wedge hold 160, is formed with an entry hole 171 in a lengthwise direction so that the tensile material 180 can enter and exit from the outside, and is formed with a support jaw 172 inside to support the lower end of the wedge hold 160 and the lower end of the buffering auxiliary spring 163 such that the flexibly installed wedge hold 160 can be smoothly operated.

Here, the head coupler 170 is coupled to the lower side of the housing 120, is provided with a packing or the like, and is coupled with normal coupling means such as screw coupling.

The operation of the present invention will be described below.

Figure 3:
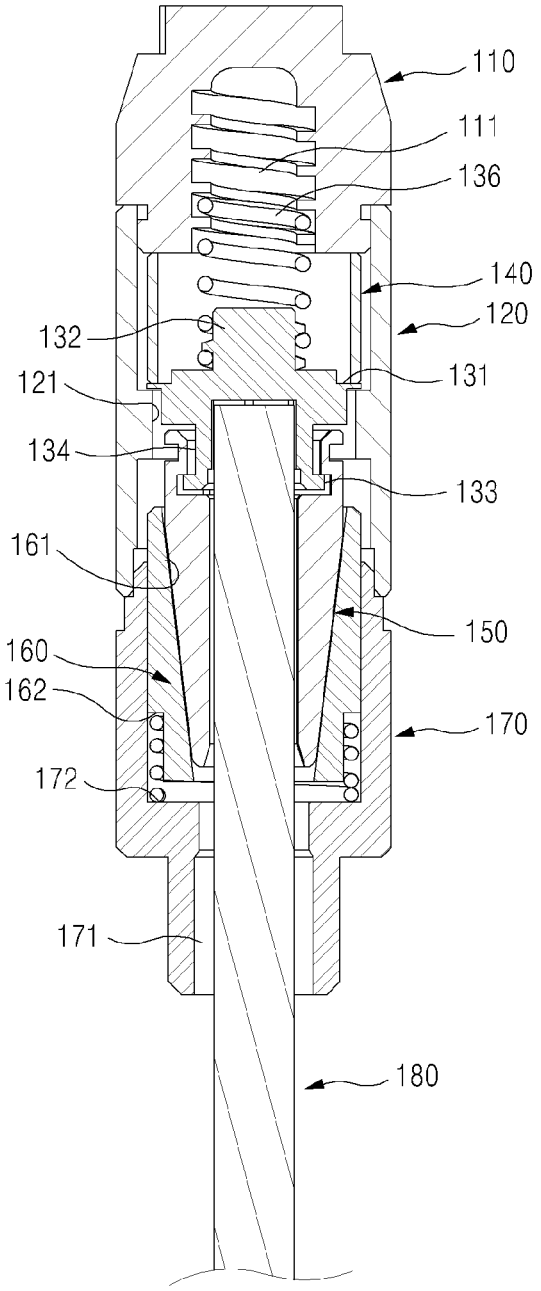
FIG. 3 is a cross to sectional view illustrating an assembled state of the removable ground anchor body using the spring according to the present invention.

First, as illustrated in FIG. 3, when the assembly of the anchor body 100 is completed, the stopper 131 of the body 130 is fit between the locking protrusion 121 of the housing 120 and the stopper presser 140, and the body 130 maintains a fixed state, the flexibly installed wedge hold 160 to face upward press-fits the strand wire wedge 150 to the tapered hole 161, thereby stably and consistently maintaining the state assembled to the tensile material 180.

Thus, even when an external impact occurs during movement or installation, it is possible to stably and consistently maintaining the assembled state.

Nevertheless, even when the stopper 131 of the body 130 is damaged due to the strong external impact energy, the rotating main spring 136 presses the strand wire wedge 150 to the tapered hole 161 of the wedge hold 160, and at the same time, the buffering auxiliary spring 163 presses the wedge hold 160 toward the strand wire wedge 150. Thus, the strand wire wedge 150 can maintain the assembled state, by continuing the state of stably fixing the tensile material 180 such as a PC strand wire. Since each of the elasticity of the rotating main spring 136 and the buffering auxiliary spring 163 acts on the upper and lower portions of the strand wire wedge 150, the elasticity strength of the rotating main spring 136 and the buffering auxiliary spring 163 is mutually offset in the upper and lower portions even in the case of the external impact, and thus, the strand wire wedge 150 can maintain a stable and perfect assembled state in the front end of the tensile material 180.

Figure 4:
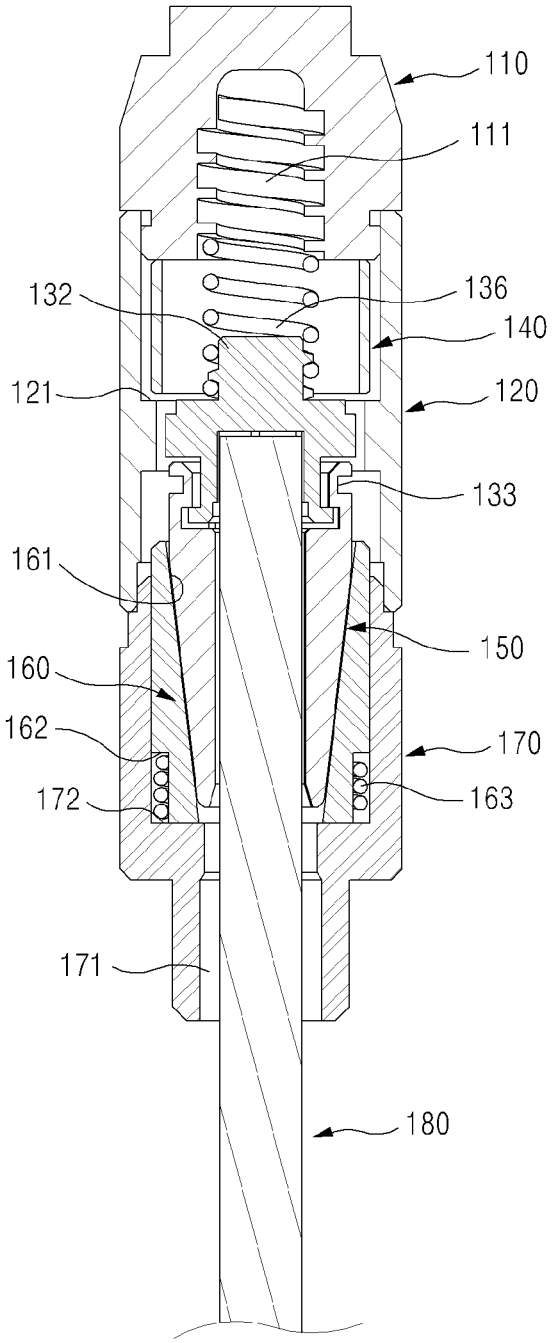
FIG. 4 is a cross to sectional view illustrating a tensile state of the removable ground anchor body using the spring according to the present invention.

As illustrated in FIG. 4, after the anchor body 100 assembled as described above is inserted into the drilled holes of the slope, the grouting is performed, and thereafter, when pulling the tension material 180, the strand wire wedge 150 is strongly pulled by tensile strength of several tons, and the strand wire wedge 150 further bites and presses the tensile material 180, while moving to the tapered hole 161 of the wedge hold 160, and thus, a rigid and strong coupling state is maintained, the tensile material 180 is smoothly and safely pulled to induce the stabilization of the structure or the like.

At this time, since the tensile material 180 is pulled by the powerful force of several tons, while the body 130 coupled to the strand wire wedge 150 is also pulled, the stopper 131 of the body 130 is crushed and removed by being locked to coupling protrusion 121 of the housing 120.

Figure 5:
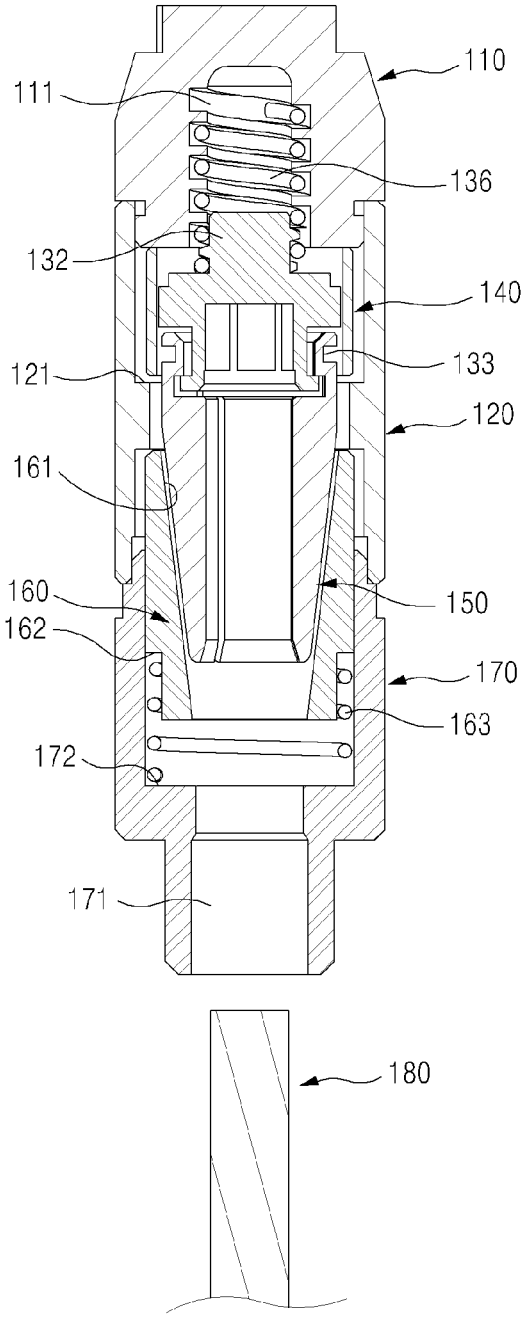
FIG. 5 is a cross to sectional view illustrating a separated state of the removable ground anchor body using the spring according to the present invention.
Figure 6:
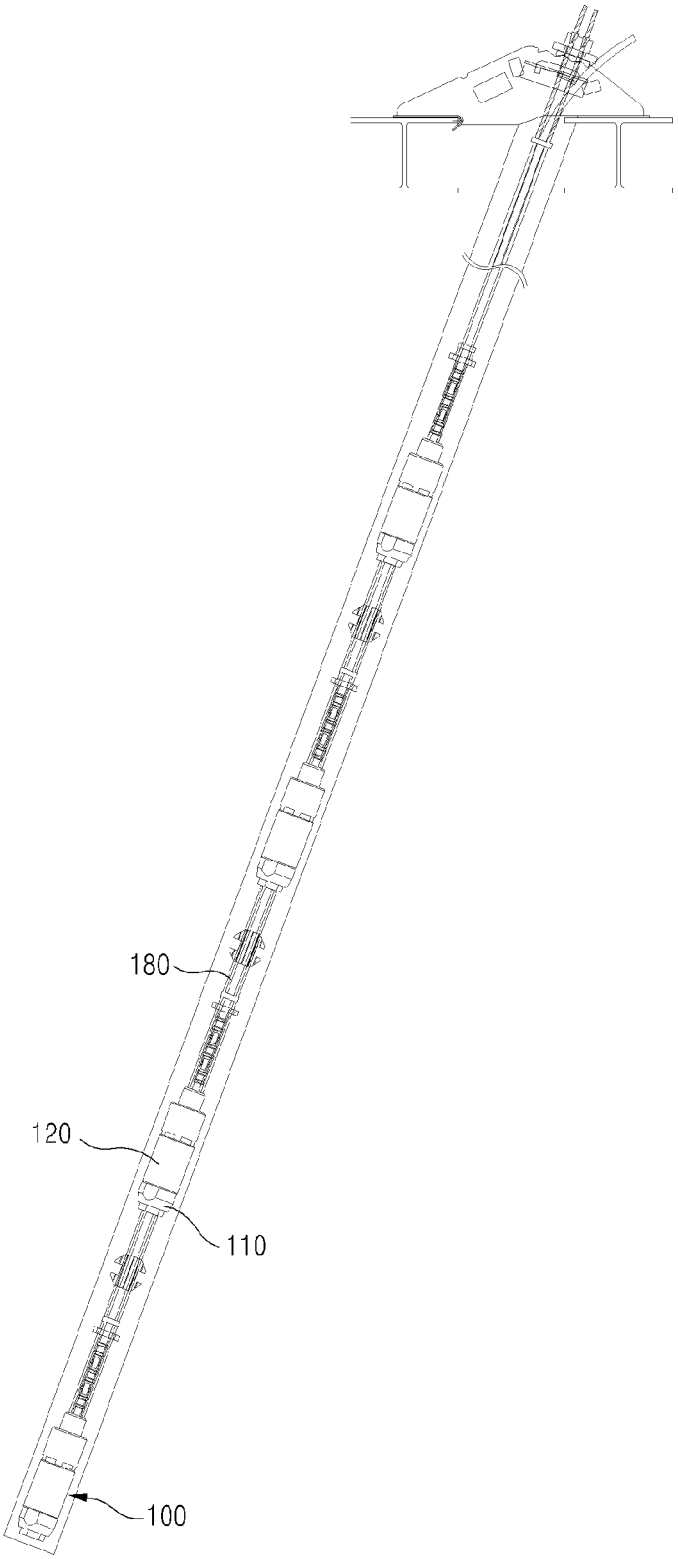
FIG. 6 is a cross to sectional view illustrating an installed state of a removing type ground anchor body using the spring according to the present invention.

As illustrated in FIG. 5, after the pulling operation of the tensile material 180, when the installation of the various structures is completed and the removal work of the tensile material 180 is performed, the tensile material 180 with a released tensile state is rotated.

At this time, the body 130 coupled to the strand wire wedge 150 also rotates in connection with the rotation of the tensile material 180, and thus, the rotating main spring 136 coupled to the body 130 also rotates.

Therefore, while the upper part of the rotating main spring 132 rotates through the screw groove 111 of the waterproof cap 110, since the spring is moved to the upper side of watertight cap 110 and the body 130 is also moved to the upper side in connection therewith, the strand wire wedge 150 coupled to the body 130 is also moved to release the locked state of the tensile material 180.

Here, the strand wire wedge 150 is smoothly expanded by an elastic band (not illustrated) to release the locked state of the tensile material 180, and pulls the rear end of the tensile material 180 in this state to remove the tensile material 180 in the slope.

In particular, in such an anchor body 100, when rotating the tensile material 180, the elasticity of the buffering auxiliary spring 163 acts on the waterproof cap 110 side to allow the strand wire wedge 150 to smoothly escape from the tapered hole 151 of the wedge hold 150, and since the stopper 131 is in a crushed and removed state, it is moved to a position at which the separation of the strand wire wedge 150 can completely and sufficiently act and escape from the tapered hole 151, and thus, it is possible to easily, conveniently and simply separate and remove the tensile material 180, thereby smoothly separating and removing the tensile material 180 with only the man power.

While the invention has been illustrated and described with reference to exemplary embodiments thereof, it will be understood by those skilled in the art that various changes in form and details may be made therein without departing from the spirit and scope of the invention as defined by the appended claims. Therefore, the scope of the invention is defined not by the detailed description of the invention but by the appended claims, and all differences within the scope will be construed as being included in the present invention.

What is claimed is:

1. A removable ground anchor body, comprising:

a waterproof cap including a screw groove located inside the waterproof cap, wherein the screw groove extends upwardly from an inner lower end of the waterproof cap;

a housing coupled to a lower portion of the waterproof cap and including a locking protrusion therein;

a rotating mainspring coupled with the screw groove;

a body coupled with the rotating main spring;

a strand wire wedge coupled to a lower portion of the body and including a plurality of pieces;

a wedge hold including a tapered hole for receiving the strand wire wedge, and including a locking jaw;

a cushioning auxiliary spring located on the locking jaw and extending downward; and a head coupler coupled to a lower portion of the housing to house and support the wedge hold therein and including an entry hole at a bottom of the head coupler for receiving a tensile material.

2. The removable ground anchor body of claim 1, further comprising:

a stopper presser located below and adjacent to the waterproof cap, and located within the housing, wherein the body comprises:

a stopper located on an outer peripheral edge of the body, and located between the stopper presser and the locking protrusion, such that the stopper is pressed against the locking protrusion by the stopper presser.

3. The removable ground anchor body using the spring of claim 1, wherein the body further comprises:

a key groove;

a coupling protrusion coupling with the strand wire wedge; and an annular coupling groove receiving an upward locking protrusion of the strand wire wedge.

4. The removable ground anchor body using the spring of claim 1, wherein the locking jaw is located on an outer peripheral portion of the wedge hold, such that the locking jaw receives a cushioning auxiliary spring, and such that the cushioning auxiliary spring supports the wedge hold above the head coupler, and wherein the head coupler includes a support jaw supporting the cushioning auxiliary spring.

5. The removable ground anchor body using the spring of claim 1, wherein the head coupler is coupled to the housing and supports the housing, wherein the head coupler comprises a support jaw receiving and supporting a cushioning auxiliary spring, and wherein the cushioning auxiliary spring is sized to fit into the locking jaw of the wedge hold.

* * * * *